US009397425B2

(12) United States Patent
Chen

(10) Patent No.: US 9,397,425 B2
(45) Date of Patent: Jul. 19, 2016

(54) ELECTRICAL CONNECTOR ASSEMBLY HAVING ENLARGED MATING POWER CONTACTS

(71) Applicant: FOXCONN INTERCONNECT TECHNOLOGY LIMITED, Grand Cayman (KY)

(72) Inventor: Ming-Ching Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/830,761

(22) Filed: Aug. 20, 2015

(65) Prior Publication Data

US 2016/0056557 A1 Feb. 25, 2016

(30) Foreign Application Priority Data

Aug. 20, 2014 (TW) ..... 103214825 U

(51) Int. Cl.

| | |
|---|---|
| ***H01R 24/62*** | (2011.01) |
| ***H01R 12/71*** | (2011.01) |
| *H01R 13/405* | (2006.01) |
| *H01R 12/57* | (2011.01) |
| *H01R 43/24* | (2006.01) |

(52) U.S. Cl.

CPC ..... *H01R 12/716* (2013.01); *H01R 12/57* (2013.01); *H01R 13/405* (2013.01); *H01R 43/24* (2013.01)

(58) Field of Classification Search

CPC ..... H01R 23/02; H01R 24/60; H01R 24/62
USPC ..... 439/660, 108
See application file for complete search history.

(56) References Cited

U.S. PATENT DOCUMENTS

| | | | | |
|---|---|---|---|---|
| 5,330,372 | A * | 7/1994 | Pope | H01R 13/26 439/682 |
| 6,379,172 | B1 * | 4/2002 | Howell | H01R 12/7088 439/259 |
| 7,198,492 | B2 * | 4/2007 | Shichida | H01R 24/50 439/581 |
| 7,901,218 | B2 * | 3/2011 | Sato | H01R 13/20 439/74 |
| 8,272,881 | B2 * | 9/2012 | Miyazaki | H01R 13/20 439/345 |
| 2013/0295784 | A1 * | 11/2013 | Hasegawa | H01R 9/091 439/55 |

(Continued)

FOREIGN PATENT DOCUMENTS

CN 103050805 12/2014

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

An electrical connector assembly includes a plug connector including an insulative housing, a number of signal contacts, and a pair of power contacts, the power contacts being insert-molded with the insulative housing; and a mating receptacle connector including an insulative housing, a number of signal contacts, and a pair of power contacts, the power contacts being insert molded with the insulative housing. Each of the plug power contacts is one-piece and has two opposing side plates, two opposing end plates interconnected with the side plates, and a soldering portion. Each of the receptacle power contacts is one-piece and has two opposing side plates, two opposing end plates interconnected with the side plates, and a soldering portion. The four side and end plates of the plug power make contact with and are received within the four plates of the receptacle power contact when the plug and receptacle connectors are mated.

20 Claims, 7 Drawing Sheets

(56) References Cited

U.S. PATENT DOCUMENTS

2014/0220830 A1* 8/2014 Kubo ..... H01R 12/73 439/660
2014/0227899 A1 8/2014 Tanaka et al.
2014/0256195 A1 9/2014 Obikane et al.
2015/0207256 A1* 7/2015 Wu ..... H01R 12/73 439/660
2015/0380845 A1* 12/2015 Goto ..... H01R 12/73 439/660

* cited by examiner

ELECTRICAL CONNECTOR ASSEMBLY HAVING ENLARGED MATING POWER CONTACTS

BACKGROUND OF THE INVENTION

1. Field of the Invention

The present invention relates to an electrical connector assembly, and more particularly to a board to board connector assembly having one-piece, large-area power contacts.

2. Description of Related Art

Certain type of board to board connectors feature narrower pitches of contacts, miniaturization, and reduced overall height of connectors. To convey power having a current of a large order, multiple power contacts can be used. Alternatively, e.g., in U.S. Pat. No. 7,901,218, issued on Mar. 8, 2011, disclosed are first and second fixtures each having at least three engaging or anchoring portions, respectively, that are engaged and therefore caused to be in electrical continuity, thereby using as power supply terminal. Similarly, U.S. Patent Application Publication No. 2013/0295784, published on Nov. 7, 2013, discloses a pair of power source terminals that are held at end section sides of a plug or receptacle housing and have different shapes from signal terminals.

Connector power contacts having large contact area for conducting large current are desired.

SUMMARY OF THE INVENTION

An electrical connector assembly comprises: a plug connector including an insulative housing, a plurality of signal contacts, and a pair of power contacts, the power contacts being insert molded with the insulative housing; and a mating receptacle connector including an insulative housing, a plurality of signal contacts, and a pair of power contacts, the power contacts being insert molded with the insulative housing; wherein each of the plug power contacts is one-piece and has two opposing side plates, two opposing end plates interconnected with the side plates, and a soldering portion, each of the receptacle power contacts is one-piece and has two opposing side plates, two opposing end plates interconnected with the side plates, and a soldering portion, and the four side and end plates of the plug power make contact with and are received within the four plates of the receptacle power contact when the plug and receptacle connectors are mated.

DETAILED DESCRIPTION OF THE PREFERRED EMBODIMENT

Figure 1:
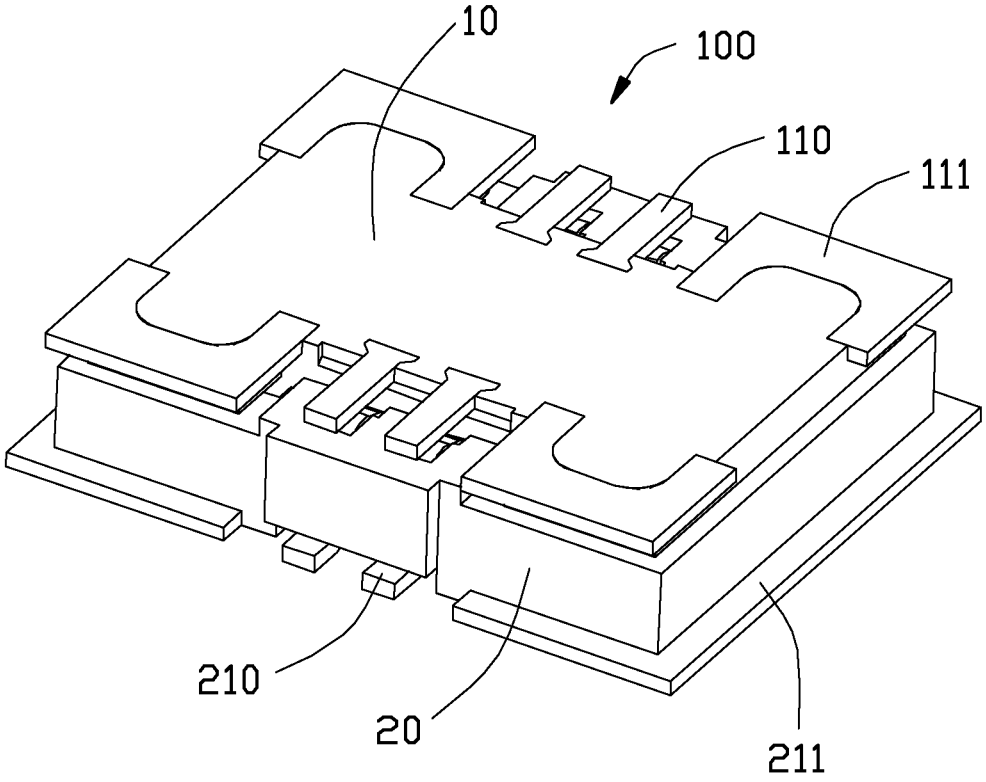
FIG. 1 is an assembled perspective view showing an electrical connector assembly in accordance with the present invention.
Figure 2:
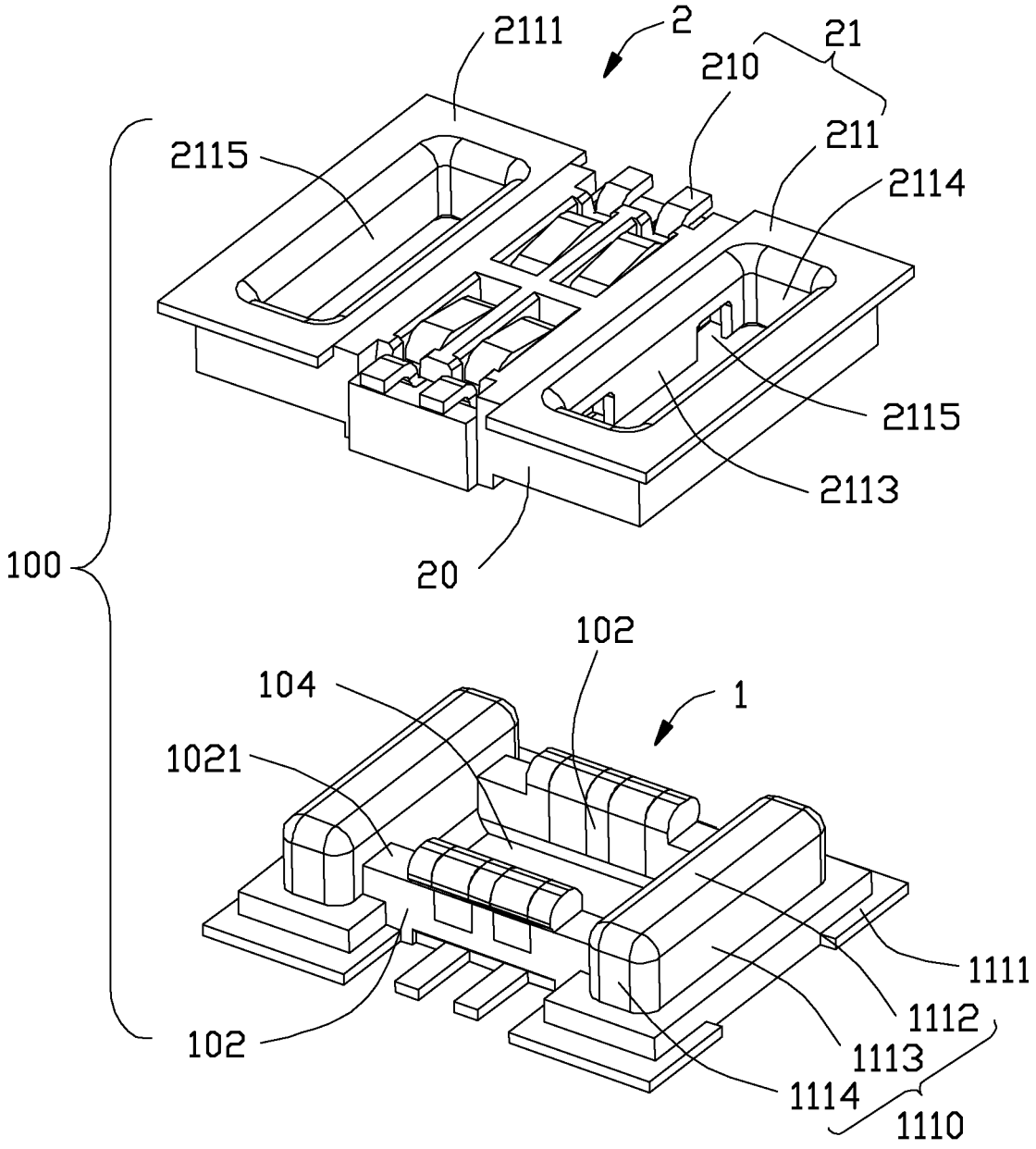
FIG. 2 is a perspective view of a plug connector and a receptacle connector of the electrical connector assembly in FIG. 1.
Figure 3:
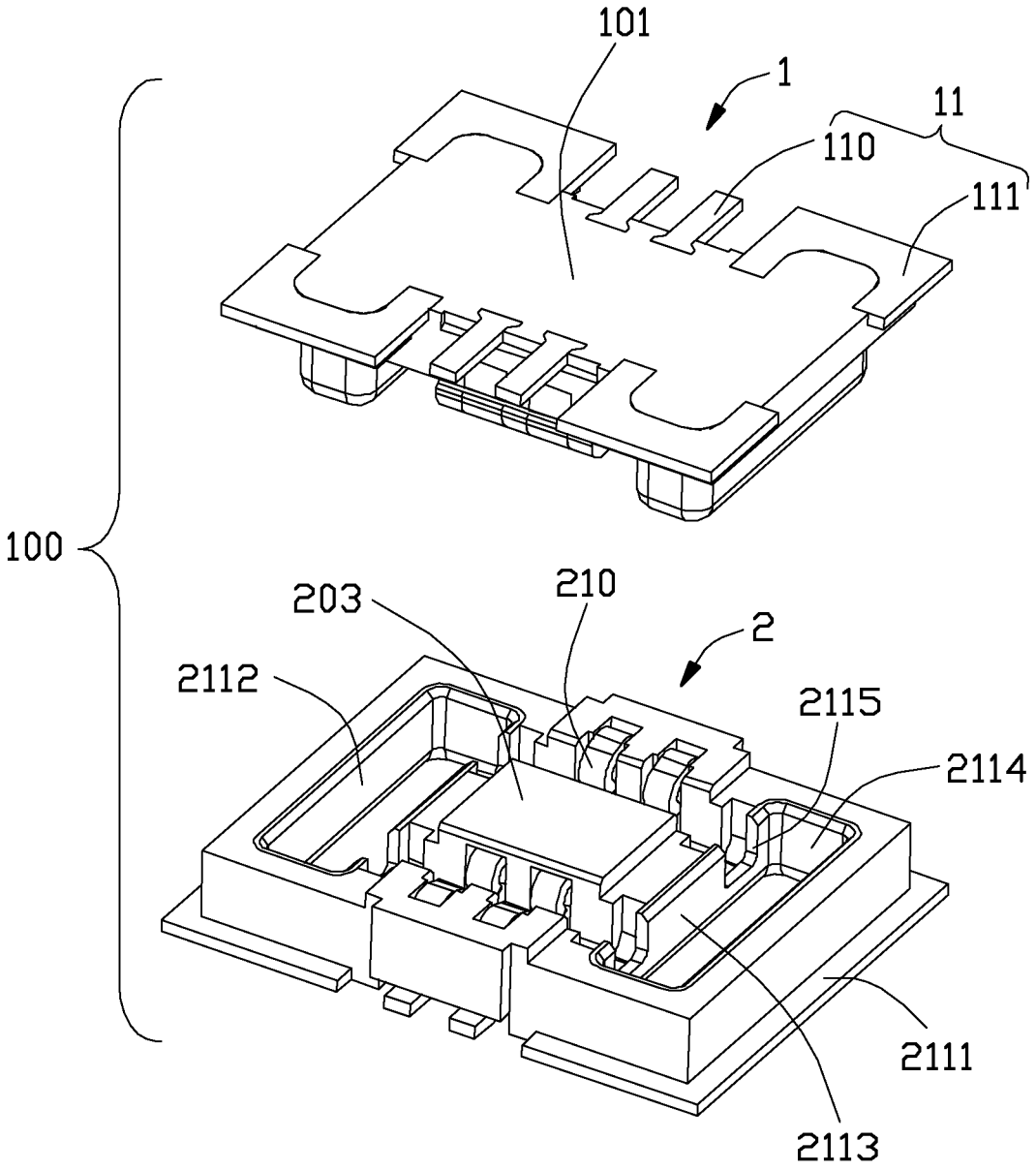
FIG. 3 is another perspective view of the plug connector and the receptacle connector in FIG. 2.
Figure 4:
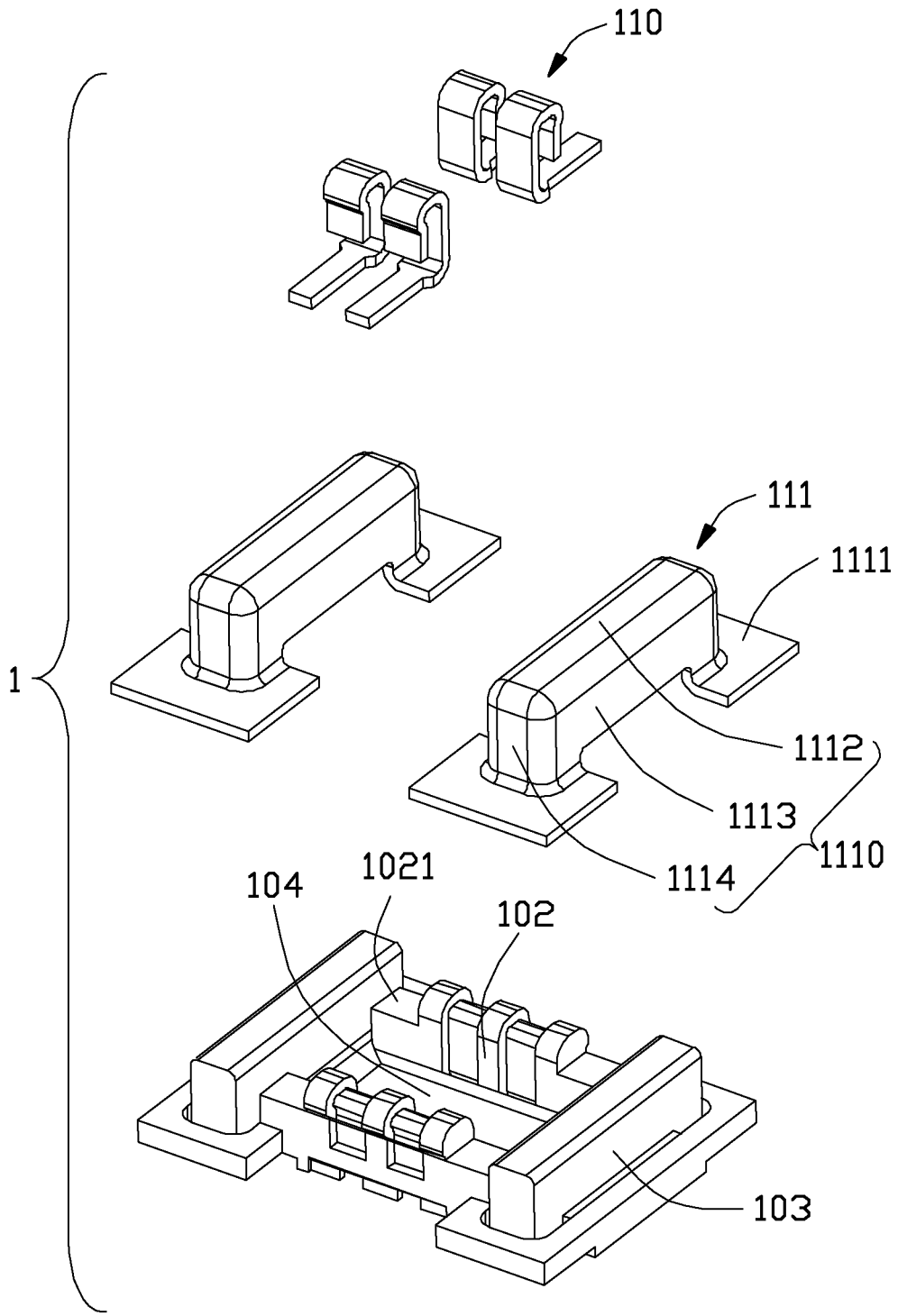
FIG. 4 is an exploded view of the plug connector in FIG. 2.
Figure 5:
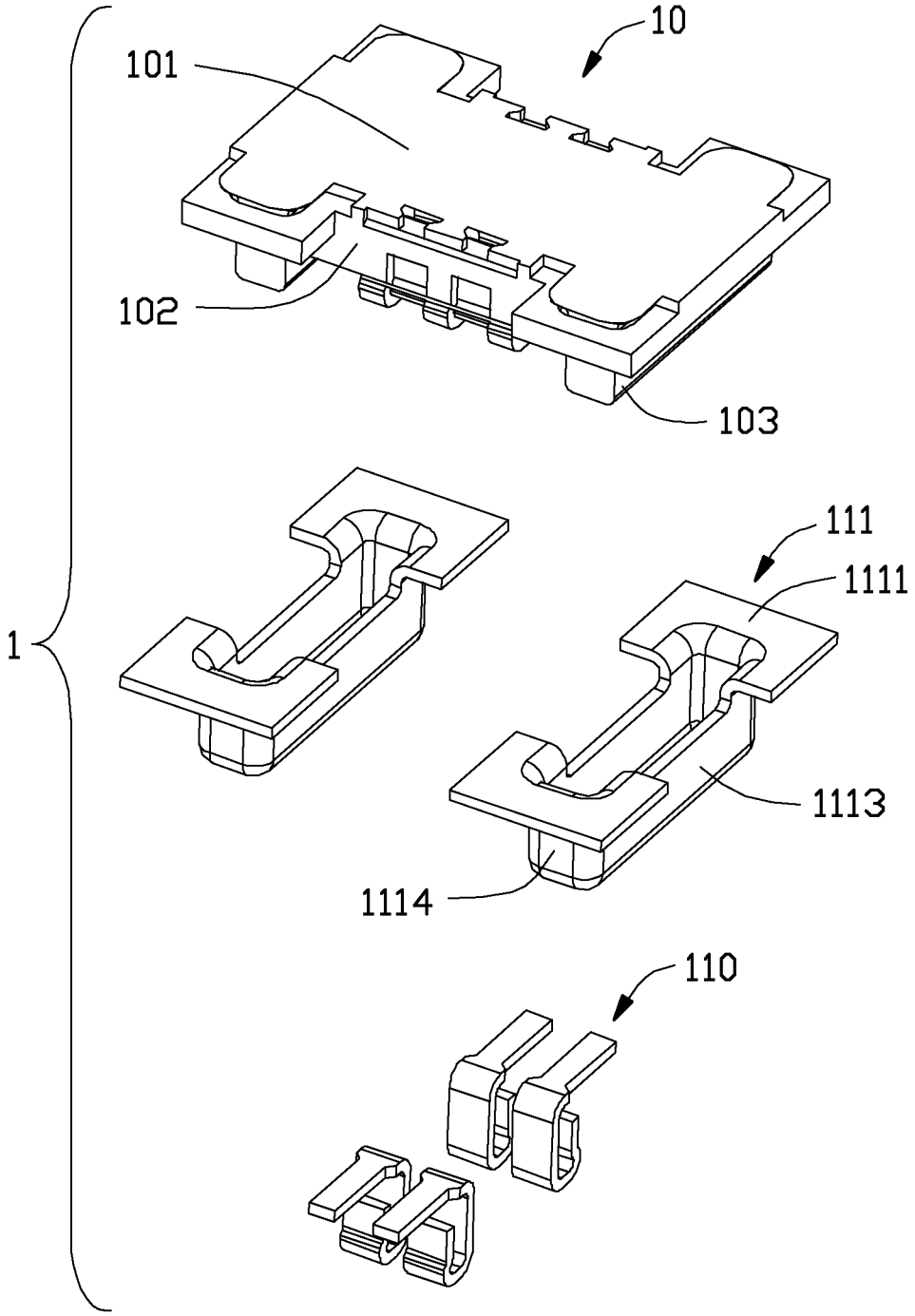
FIG. 5 is another exploded view of the plug connector in FIG. 2.
Figure 6:
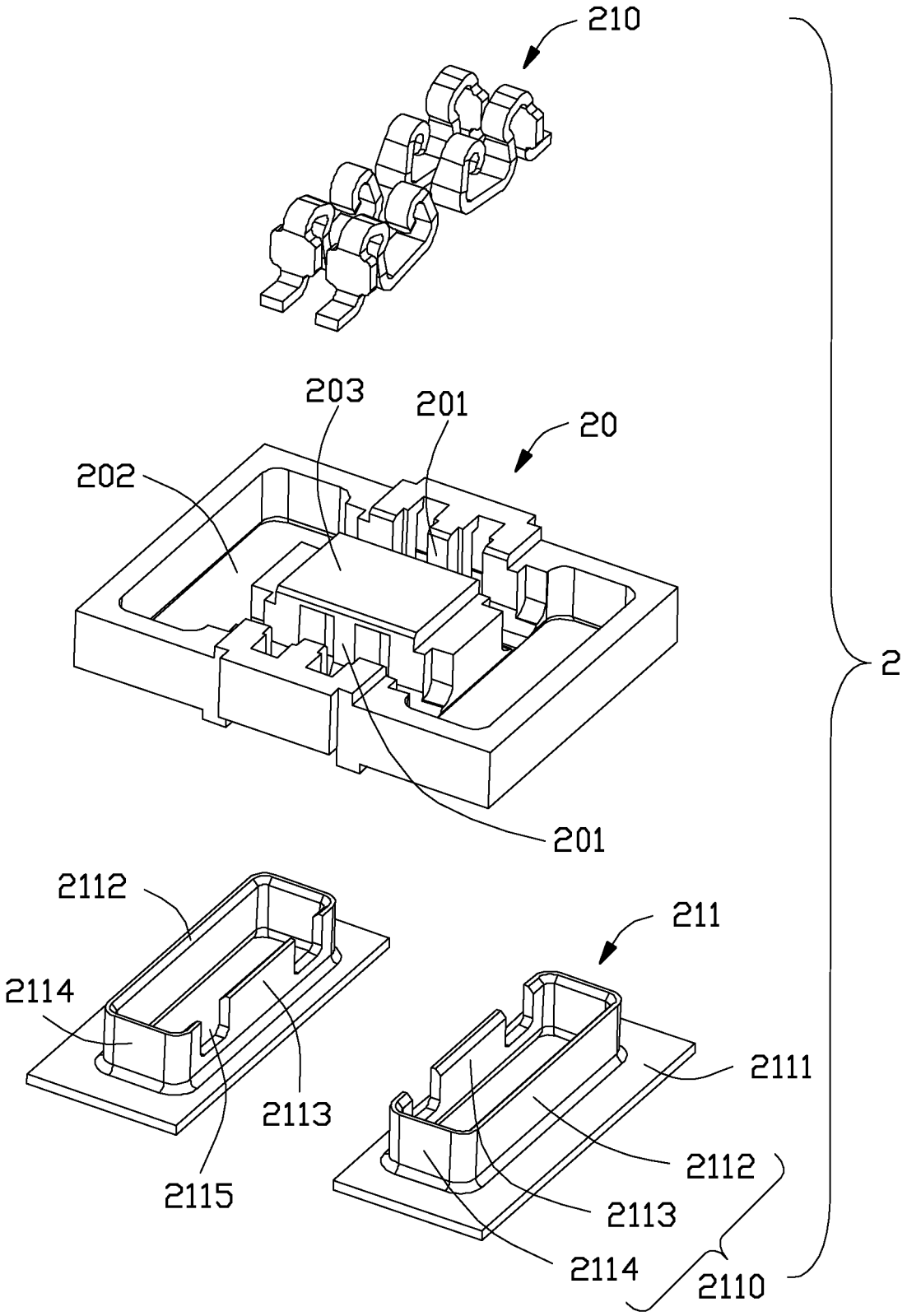
FIG. 6 is an exploded view of the receptacle connector in FIG. 3.
Figure 7:
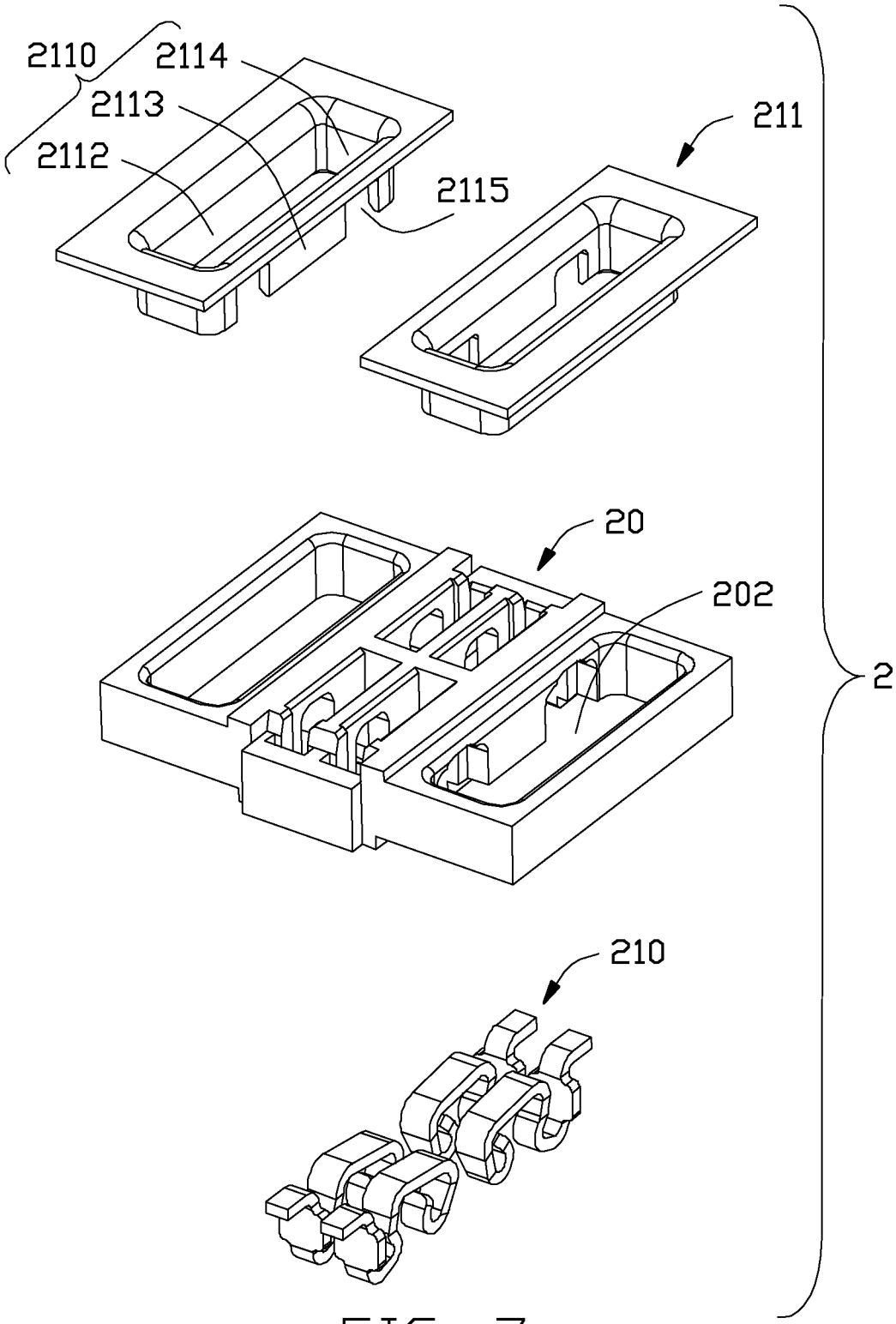
FIG. 7 is another exploded view of the receptacle connector in FIG. 3.

Referring to FIGS. 1 through 7, an electrical connector assembly 100 includes a plug connector 1 and a mating receptacle connector 2. The plug and receptacle connectors 1 and 2 are configured as board-mounted type connectors.

Referring specifically to FIGS. 2 to 5, the plug connector 1 comprises an insulative housing 10 and a plurality of contacts insert molded with the insulative housing 10. The insulative housing 10 includes a bottom wall 101, two side walls 102, and two end walls 103. The bottom wall 101, side walls 102, and end walls 103 together define a receiving recess 104. Both edges of the side wall 102 at the junction with the end walls 103 are downwardly formed with recessed portions 1021.

The plug contacts include two pairs of signal contacts 110 at the side walls 102 and a pair of power contacts 111 at the end walls 103. The signal contacts 110 are designed same as conventional board-to-board connector contacts. The power contact 111 is one-piece and includes a contact portion 1110 and a skirt located at both ends of the contact portion 1110 to form a soldering portion 1111. The contact portion 1110 is shaped like a rectangular barrel and includes a base plate 1112, two opposing side plates 1113, two opposing end plates 1114 interconnected with the side plates 1113. The base plate may be omitted in other embodiment. If provided, the base plate 1112 is interconnected with the two side plates 1113 and the two end plates 1114, and an interior space is enclosed by the five plates 1112, 1113, 1114 which is filled up with a part of the insulative housing 10 during insert-molding. The soldering portion 1111 extends outwardly from around a junction of the end plates 1114 and the side plates 1113. The contact portion 1110 is provided in the end wall in order to have a large contact area at an outer surface thereof. The soldering portion 1111 extends outside of the insulative housing 10.

Referring specifically to FIGS. 2-3 and 5-6, the receptacle connector 2 comprises a substantially parallelepiped insulative housing 20 and a plurality of contacts 21 fixed to the insulative housing 20. The insulative housing 20 has an inwardly recessed groove 201 for accommodating the plug connector side walls 102 and a receiving cavity 202 near the ends thereof in communication with the groove 201. The cavity 202 extends through the insulative housing 20. The insulative housing 20 has a land 203.

The receptacle contacts 21 include two pairs of signal contacts 210 fixed to the housing 20 and exposed to the groove 201 and a pair of power contacts 211 fixed to the housing 20 in the cavity 202. The signal contacts 210 are designed same as conventional board-to-board connector contacts. The power contact 211 is one-piece and includes a contact portion 2110 and a skirt forming a soldering portion 2111. The contact portion 2110 includes two opposing side plates 2112 and 2113, two opposing end plates 2114 interconnected with the side plates. Inner side plate 2113 has two notches 2115. The notch 2115 enables the groove 201 to communicate with the cavity 202 and accommodate the plug side wall 102. The notch 2115 also corresponds to the recessed portion 1021 of the side wall 102.

The plug power contact side plates and end plates 1113, 1114 and receptacle power contact side plates and end plates 2112, 2113, 2114 all exhibit a flat plate construction. The four side and end plates of the plug power make contact with and are received within the four plates of the receptacle power contact when the plug and receptacle connectors are mated. Therefore, four different contact points or areas can be made to ensure large contact area for conducting large current.

What is claimed is:

1. An electrical connector assembly comprising:

a plug connector including an insulative housing, a plurality of signal contacts, and a pair of power contacts, the power contacts being insert molded with the insulative housing; and a mating receptacle connector including an insulative housing, a plurality of signal contacts, and a pair of power contacts, the power contacts being insert molded with the insulative housing; wherein each of the plug power contacts is one-piece and has two opposing side plates, two opposing end plates interconnected with the side plates, and a soldering portion, each of the receptacle power contacts is one-piece and has two opposing side plates, two opposing end plates interconnected with the side plates, and a soldering portion, and the four side and end plates of the plug power make contact with and are received within the four plates of the receptacle power contact when the plug and receptacle connectors are mated.

2. The electrical connector assembly according to claim 1, wherein the plug power contact comprises a base plate interconnected with the two side plates and the two end plates, and an interior space is enclosed by the five plates of the plug power contact and filled up with a part of the insulative housing.

3. The electrical connector assembly according to claim 1, wherein the side plate of the plug power contact has a notch at an inner side thereof for accommodating a side wall of the receptacle insulative housing.

4. An electrical connector assembly comprising:

a plug connector for coupling to a receptacle connector, including:

an insulative housing having a pair of side walls and a pair of end walls commonly forming therein a circumferentially closed receiving recess exposed to an exterior in a vertical direction;

said pair of side walls being opposite to each other in a transverse direction perpendicular to said vertical direction, and each of said pair of side walls extending along a longitudinal direction perpendicular to both said vertical direction and said transverse direction;

said pair of end walls being opposite to each other in said longitudinal direction and each of said pair of end walls extending along said transverse direction;

a pair of power contacts each having a contacting section enclosing the corresponding end wall; and at least a pair of signal contacts each having a contacting portion enclosing a part of the corresponding side wall.

5. The electrical connector assembly as claimed in claim 4, wherein each of said side walls forms a pair of recessed portion adjacent to the corresponding end walls, respectively.

6. The electrical connector assembly as claimed in claim 4, wherein each of said power contacts includes a soldering section horizontally extending under a bottom face of the housing, and each of said signal contacts include a soldering portion horizontally extending under the bottom face of the housing.

7. The electrical connector assembly as claimed in claim 6, wherein said power contacts and said signal contacts are both assembled to the housing via an insert-molding process.

8. The electrical connector assembly s claimed in claim 6, wherein in each power contact, the contacting section forms a pair of long sides opposite to each other in the longitudinal direction and each extending along the transverse direction, and a pair of short sides opposite to each other in the transverse direction and each extending along the longitudinal direction, said pair of long sides and said pair of short sides being joined with each other to circumferentially enclose the corresponding end wall, and a top side linked to top portions of said pair of long sides and those of said pair of short sides.

9. The electrical connector assembly as claimed in claim 8, wherein in each power contact, the soldering section is composed of a pair of parts opposite to each other in said transverse direction.

10. The electrical connector assembly as claimed in claim 8, wherein the receptacle connector includes a pair of power terminals each defining a mating section with a pair of long sections and a pair of short sections joined with each other to commonly form a space for receiving the corresponding power contact therein during mating, said pair of long sections being opposite to each other in the longitudinal direction and each extending along the transverse direction while said pair of short sections being opposite to each other in the transverse direction and each extending along the longitudinal direction.

11. The electrical connector assembly as claimed in claim 10, wherein in each power terminal, an inner one of said pair of long sections forms a pair of notches for receiving the corresponding side walls, respectively, during mating.

12. The electrical connector assembly as claimed in claim 10, wherein each power terminal further includes a mounting section with a frame structure thereof.

13. An electrical connector assembly comprising:

a receptacle connector for mating with a plug connector, including an insulative housing including a pair of side walls and a pair of end walls commonly forming a circumferentially closed receiving space exposed to an exterior in a vertical direction, in which a land upwardly extends, said pair of side walls being opposite to each other in a transverse direction perpendicular to said vertical direction and each of said pair of side walls extending along a longitudinal direction perpendicular to both said vertical direction and said transverse direction;

said pair of end walls being opposite to each other in the longitudinal direction and each extending along the transverse direction;

said receiving space including a pair of recessed grooves and a pair of receiving cavities surrounding said land;

a pair of power terminals disposed in the corresponding receiving cavities, respectively; and at least a pair of signal terminals disposed in the corresponding recessed grooves, respectively; wherein each of said recessed grooves communicates with said pair of receiving cavities in said longitudinal direction.

14. The electrical connector assembly as claimed in claim 13, wherein each of said power terminals includes a mating section with a pair of side plates and a pair of end plates joined with each other to form a circumferential closed space for receiving a corresponding power contact of the plug connector during mating.

15. The electrical connector assembly as claimed in claim 14, wherein an inner one of said pair of side plates forms a pair of notches each to allow the recessed groove to communicate with the corresponding receiving cavities, respectively, in said longitudinal direction.

16. The electrical connector assembly as claimed in claim 14, wherein each of said power terminal further includes a mounting section exposed upon an underside of the housing with a frame structure thereof.

17. The electrical connector assembly as claimed in claim 16, wherein said frame structure defines a rectangular four sides, of which three sides laterally extend and are upwardly exposed to the exterior.

18. The electrical connector assembly as claimed in claim 16, wherein in each of said power terminals, the mating section unitarily extends from the mounting section via a drawing procedure.

19. The electrical connector assembly as claimed in claim 18, wherein the mating section is embedded within the corresponding receiving cavity via an insert-molding process.

20. The electrical connector assembly as claimed in claim 19, each of said pair of signal terminals is upwardly assembled into the corresponding recessed groove from an underside of the housing.

* * * * *